US008813401B2

(12) United States Patent
Diercks

(10) Patent No.: US 8,813,401 B2
(45) Date of Patent: Aug. 26, 2014

(54) MULTI-PURPOSE STAND(S)

(71) Applicant: Mattherhorn Innovations, LLC, Cedar Fall, IA (US)

(72) Inventor: Galen Diercks, Cedar Falls, IA (US)

(73) Assignee: Matterhorn Innovations, LLC, Cedar Falls, IA (US)

( * ) Notice: Subject to any disclaimer, the term of this patent is extended or adjusted under 35 U.S.C. 154(b) by 0 days.

(21) Appl. No.: 14/058,394

(22) Filed: Oct. 21, 2013

(65) Prior Publication Data

US 2014/0041267 A1 Feb. 13, 2014

Related U.S. Application Data

(62) Division of application No. 13/236,779, filed on Sep. 20, 2011.

(60) Provisional application No. 61/384,595, filed on Sep. 20, 2010.

(51) Int. Cl.
*G09F 15/00* (2006.01)
*G09F 7/18* (2006.01)

(52) U.S. Cl.
CPC ..... *G09F 15/0018* (2013.01); *G09F 7/18* (2013.01); *G09F 2007/1821* (2013.01); *G09F 2007/1847* (2013.01)
USPC ..... 40/607.06; 40/607.11; 40/659; 273/407

(58) Field of Classification Search
CPC ... G09F 7/18; G09F 15/0018; G09F 15/0037; G09F 2007/1821; G09F 2007/1834; G09F 2007/1847; G09F 3/16
USPC ..... 40/607.01, 607.05, 607.06, 607.1, 40/607.11, 659; 273/407
See application file for complete search history.

(56) References Cited

U.S. PATENT DOCUMENTS

| | | | | | |
|---|---|---|---|---|---|
| 2,333,302 | A | * | 11/1943 | Enk | 40/643 |
| 2,456,302 | A | | 12/1948 | Mocnik | |
| 2,722,420 | A | | 11/1955 | Adamson | |
| 2,890,051 | A | | 6/1959 | Williams | |
| 3,080,166 | A | * | 3/1963 | Clark | 273/407 |
| 3,398,475 | A | * | 8/1968 | Palmer | 40/658 |
| 3,474,555 | A | * | 10/1969 | McCaffrey | 40/659 |
| 3,494,057 | A | * | 2/1970 | Ford | 40/587 |
| 3,540,729 | A | * | 11/1970 | Rahberger | 273/407 |
| 3,557,474 | A | * | 1/1971 | Palmer | 40/659 |
| 3,613,897 | A | | 10/1971 | Filler | |
| D247,265 | S | * | 2/1978 | Ledebuhr | D20/43 |
| 4,173,086 | A | * | 11/1979 | Hempfling | 40/607.03 |
| 4,323,251 | A | * | 4/1982 | Loveland et al. | 273/407 |
| 4,658,527 | A | * | 4/1987 | Pingel | 40/607.01 |
| 5,067,683 | A | * | 11/1991 | Wager | 248/545 |

(Continued)

*Primary Examiner* — Gary Hoge
(74) *Attorney, Agent, or Firm* — McKee, Voorhees & Sease

(57) ABSTRACT

A multi-purpose reversible target includes a target body having a first side and a second side, a plurality of target areas printed on the first side of the target body, and a plurality of tabs integral with the target body and on the second side of the target body. A stand includes an elongated body having a top end and an opposite bottom end, the bottom end configured for insertion into ground and at least one holder comprising a first loop and a second operatively connected to the first loop to thereby allow for friction fit of an edge of signage between the first loop and the second loop.

7 Claims, 13 Drawing Sheets

(56) References Cited

U.S. PATENT DOCUMENTS

| | | | | | |
|---|---|---|---|---|---|
| 5,083,390 | A | * | 1/1992 | Edman | 40/607.02 |
| 5,211,404 | A | | 5/1993 | Grant | |
| 5,280,920 | A | | 1/1994 | Knapper, II | |
| 5,375,801 | A | * | 12/1994 | Porter | 248/156 |
| 5,671,924 | A | * | 9/1997 | Scott | 273/407 |
| 5,678,824 | A | | 10/1997 | Fortier et al. | |
| 5,860,654 | A | | 1/1999 | Jacobs | |
| 6,170,183 | B1 | * | 1/2001 | Keefe | 40/607.03 |
| 6,435,512 | B1 | | 8/2002 | Beckwith, Sr. | |
| 6,547,204 | B1 | * | 4/2003 | Peck | 248/545 |
| 6,755,711 | B2 | | 6/2004 | McClung et al. | |
| 7,422,217 | B2 | | 9/2008 | Hinnant | |
| 7,845,646 | B1 | | 12/2010 | Weber | |
| 2007/0158912 | A1 | | 7/2007 | Hartwig et al. | |
| 2009/0079136 | A1 | | 3/2009 | Shalosky | |

* cited by examiner

MULTI-PURPOSE STAND(S)

CROSS-REFERENCE TO RELATED APPLICATIONS

This application is a divisional application of U.S. Ser. No. 13/236,779 filed Sep. 20, 2011, and claims priority under 35 U.S.C. §119 to provisional application Ser. No. 61/384,595 filed Sep. 20, 2010, herein incorporated by reference in its entirety.

FIELD OF THE INVENTION

The present invention relates to shooting targets. More specifically, but not exclusively, the present invention relates to a multi-purpose reversible target and related stands and display.

BACKGROUND OF THE INVENTION

Shooting is a popular and growing sport. Targets are used for various purposes including for practice, competition, and sighting weapons. One of the problems with targets is that they have limited life or function. What is needed is a versatile target with an extended life.

Another problem with use of targets relates to supporting the target itself. Ad hoc methods are often used to support targets during target practice. What is needed is a better way to support targets, especially one which would also be suitable for other purposes, such as supporting signage.

SUMMARY OF THE INVENTION

Therefore, it is a primary object, feature, or advantage of the present invention to improve over the state of the art.

It is a further object, feature, or advantage of the present invention to provide a multi-purpose and versatile target.

A further object, feature, or advantage of the present invention is to provide a means for supporting targets.

Yet another object, feature, or advantage of the present invention is to provide a means for holding clay targets.

A still further object, feature, or advantage of the present invention is to provide a single apparatus with multiple targets.

Yet another object, feature, or advantage of the present invention is to provide a display for use in marketing multi-purpose reversible targets and stands which is effective.

A still further object, feature, or advantage of the present invention is to provide stands suitable for holding targets or signs.

A still further object, feature, or advantage of the present invention is to provide a display suitable for use in a store to display targets and stands available for sale.

One or more of these and/or other objects, features, or advantages of the present invention will become apparent from the specification and claims that follow. No single embodiment need exhibit all of these objects, features, and advantages.

According to one aspect, a multi-purpose reversible target is provided. The target includes a target body having a first side and a second side. There are also target areas printed on the first side of the target body. Tabs integral with the target body are on the second side of the target body. The target body may be formed of cardboard. The target body may be supported by a first stand and a second stand, each of the stands having an elongated body with a top and a bottom and at least one holder between the top and the top and the bottom.

According to another aspect, a system of support for signage is provided. The system includes a first stand and a second stand. Each of the first stand and the second stand includes an elongated body having a top end and an opposite bottom end, the bottom end configured for insertion into ground. Each stand further includes at least one holder operatively connected to the elongated body and comprising a first loop and a second operatively connected to the first loop to thereby allow for friction fit of an edge of the signage between the first loop and the second loop. The bottom end of each stand may have both a first prong and a second prong for insertion into the ground. The first stand and the second stand may be formed from a wire or rod with lighter weight curly q wire being welded thereto.

DETAILED DESCRIPTION

Figure 1:
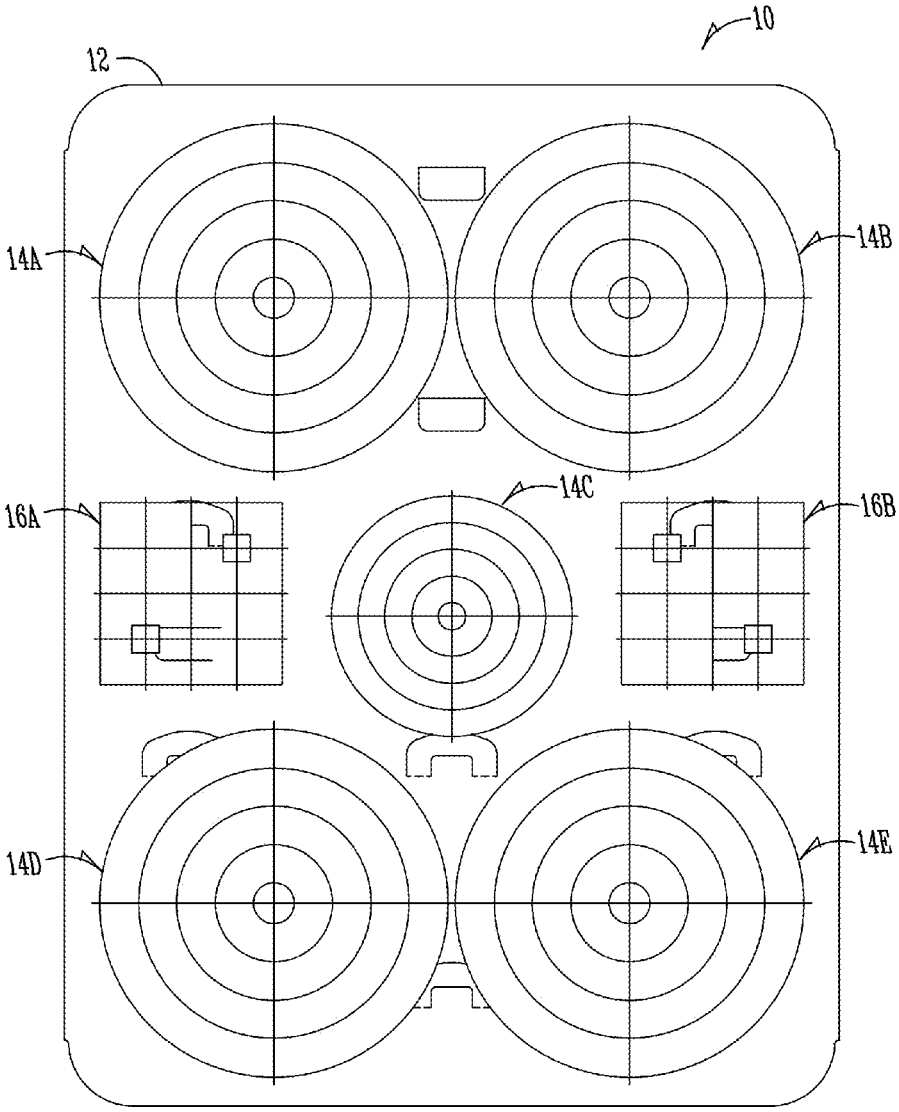
FIG. 1 illustrates a target body having a plurality of target areas printed on a first side of the target body.

FIG. 1 illustrates a target body 10 having a plurality of target areas printed on a first side 12 of the target body 10. The target areas may include bullseye targets 14A, 14B, 14C, 14D, 14E as well as grid targets 16A, 16B. Of course other types of targets may be present such as pictorial representations of animals. Preferably, however, there are a number of different target areas present to assist in enhancing the versatility of the target body 10. The target body 10 is preferably formed of cardboard.

Figure 2:
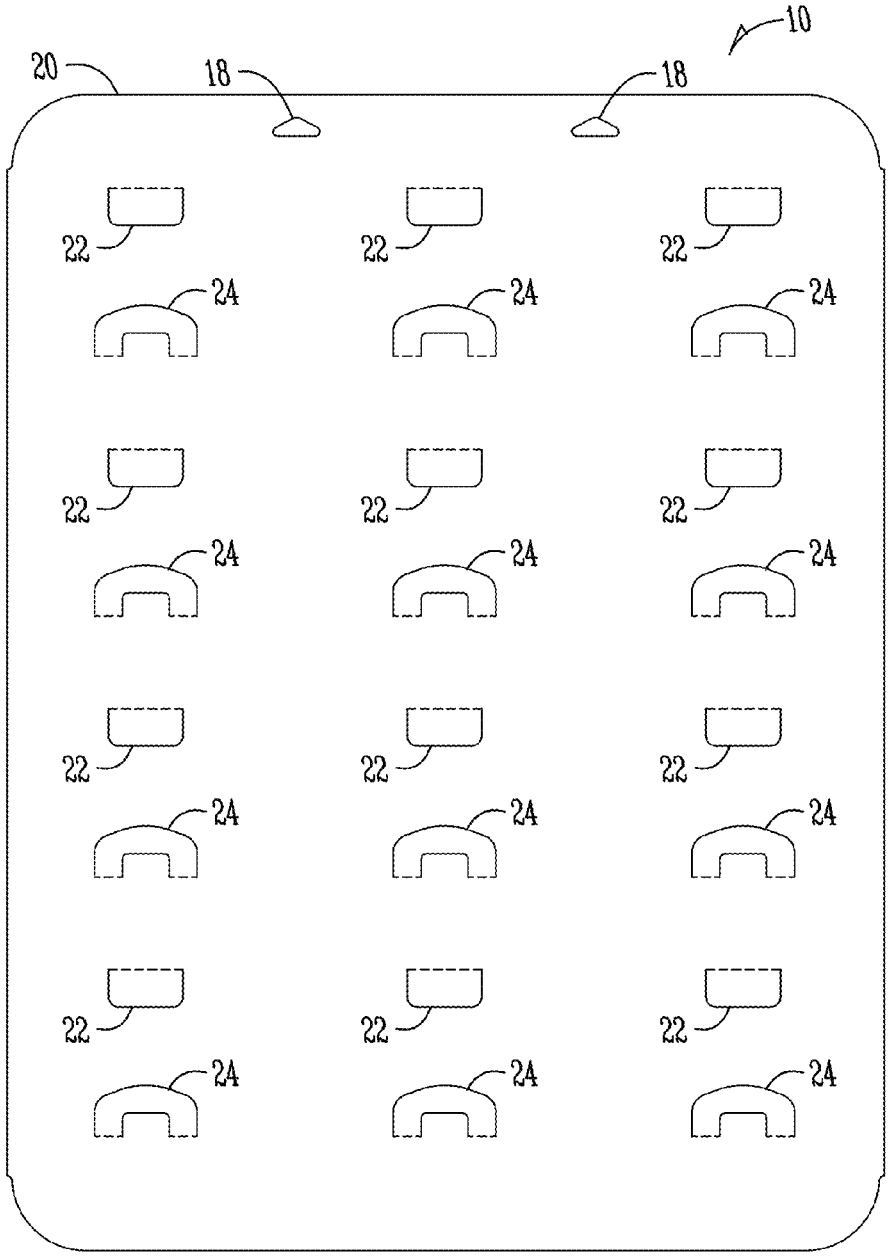
FIG. 2 illustrates a second side of the target body where tabs are present which may be used for holding clay pigeons or paper targets.

The target body 10 shown in FIG. 1 is reversible. FIG. 2 illustrates a second side 20 of the target body 10 where a plurality of clips or tabs 22, 24 are present which may be used for holding clay targets or paper targets. As shown in FIG. 2, each top tab 22 has a corresponding bottom tab 24. One use for the tabs 22, 24 is to hold clay targets. The bottom tab 24, when it folds back, creates a pocket for the clay target to drop into it so as to securely maintain the clay target in place. Thus, use of the target to hold clay targets is advantageous over ad hoc methods of placing clay targets Another use for the tabs 22, 24 is to hold additional targets such as paper targets. The size, shape, and geometry 22, 24 are well-suited for holding clay targets, although the present invention contemplates numerous variations in the particular structure, size, shape, and number of tabs or clips present. Preferably the target body 10 is made of cardboard or other material and the tabs 22, 24 are integrally formed with the rest of the target body. For example the second side 20 may be die-cut hinged tab.

In addition, at the top of the target body are pegboard hook loops 18. The pegboard hook loops allow the target body to be suspended by hooks on a pegboard. This allows the target to be easily stored as well as displayed.

Figure 3:
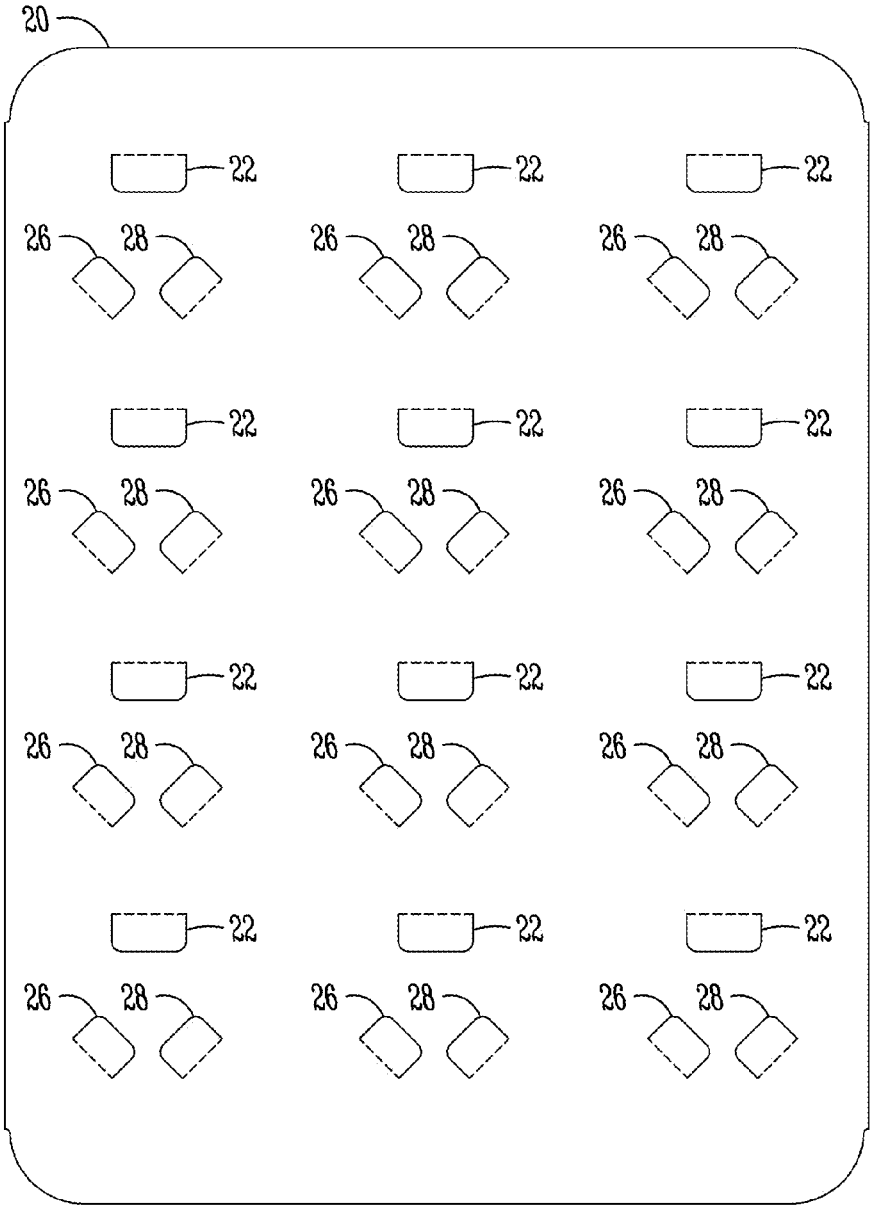
FIG. 3 illustrates another embodiment of the second side of the target body where tabs are shown with alternative shape.

FIG. 3 illustrates another embodiment of the second side of the target body where the clips or tabs are shown with alternative shape. In FIG. 3, each top tab 22 has corresponding bottom tabs 26, 28 which are positioned at an angle and are also suitable for holding clay pigeons.

Thus, the target is versatile and may be used for numerous purposes including as a plain target (with multiple target areas), as a clay pigeon holder, to hold paper targets as well as a backer for other targets.

Where the target body is cardboard, the target body may be formed by printing and then die cutting. Preferably the corrugation is in the vertical direction, but it need not be. This orientation creates stronger resistance and better paper memory to spring or hinge the tabs back. Although various types of cardboard may be used, the cardboard may have a wall strength (as measured with an Edge Crust Test, "ECT") of 44 and B flute corrugation. Other types of cardboard may be using with other types of fluting for corrugation or other wall strengths. Alternatively mullen board or fiber board may be used.

Figure 4:
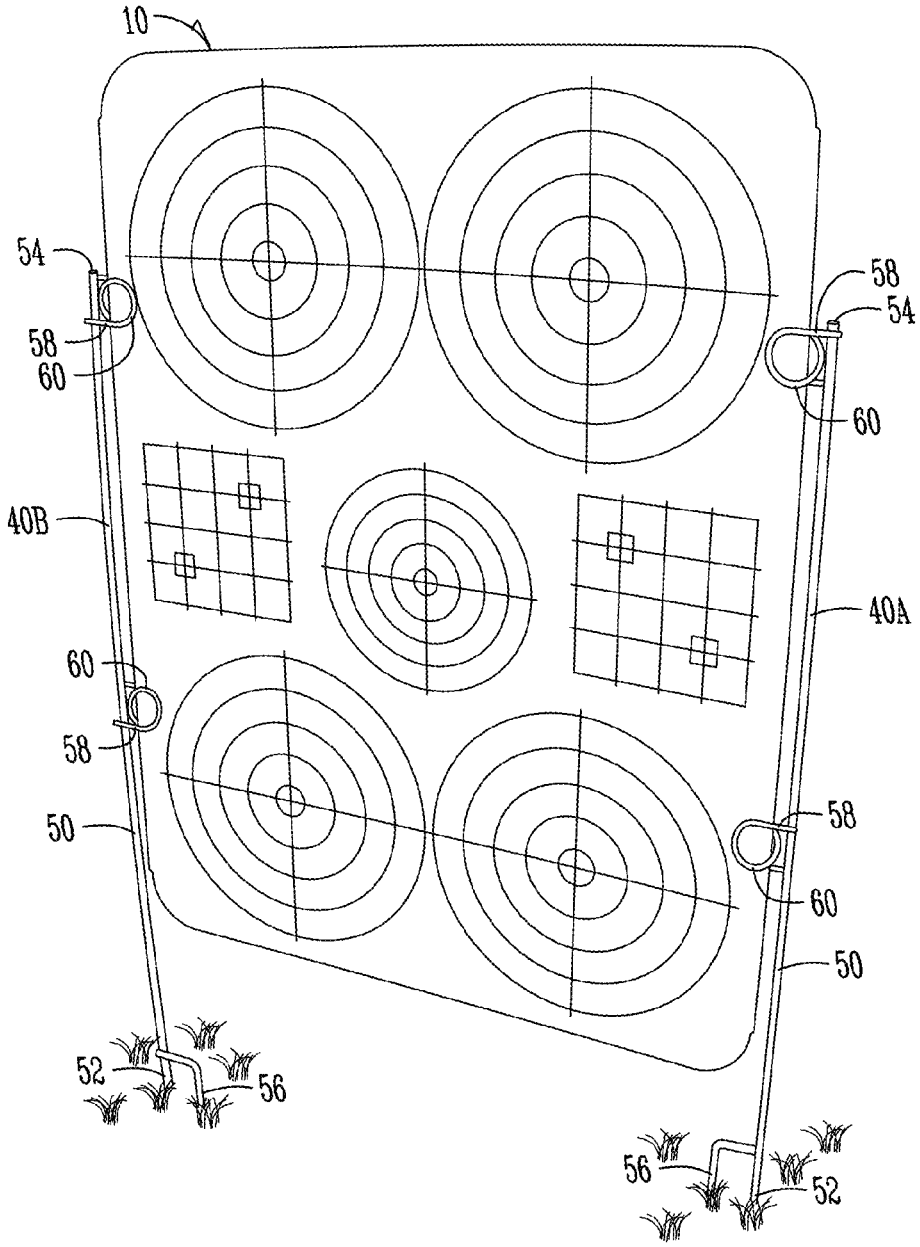
FIG. 4 illustrates the target body being supported by a first and a second stand.

FIG. 4 illustrates the target body being supported by a first and a second stand 40A, 40B. Each stand 40A, 40B, may include an elongated body 50 with first and second opposite bottom and top ends 52, 54. The bottom end 52 serves as a stake. For additional support, an additional structure 56 is provided for insertion into the ground. The additional structure 56 may be in the form of a right angle. In addition, holders 58 are positioned along the elongated body 50. The holders 58 have an annular shape suitable for clipping the target body 10 in place. Preferably, each holder 58 has a double loop structure 60 so that edges of the target may be positioned between the loops of the double loop structure 60. The stand may be formed from a heavier steel upright rod assembly. A lighter weight curly Q steel wire may then be attached (such as through welding) to the rod to form the holder. Using the lighter weight curly Q allows for better flexibility and ease of inserting targets and signage into the curly Q. Attaching the lightweight curly Q (welded) to a heavier steel upright "rod" material allows for a much more rigid stand. This allows for a taller, stronger device. This design allows the user to attach a taller, heavier target or sign to the stand. This design with the heavier, stronger "rod" upright offers desirable wind resistance and rigidity. The lighter weight curly Q may flex apart to allow for insertion of a target or sign.

Figure 5:
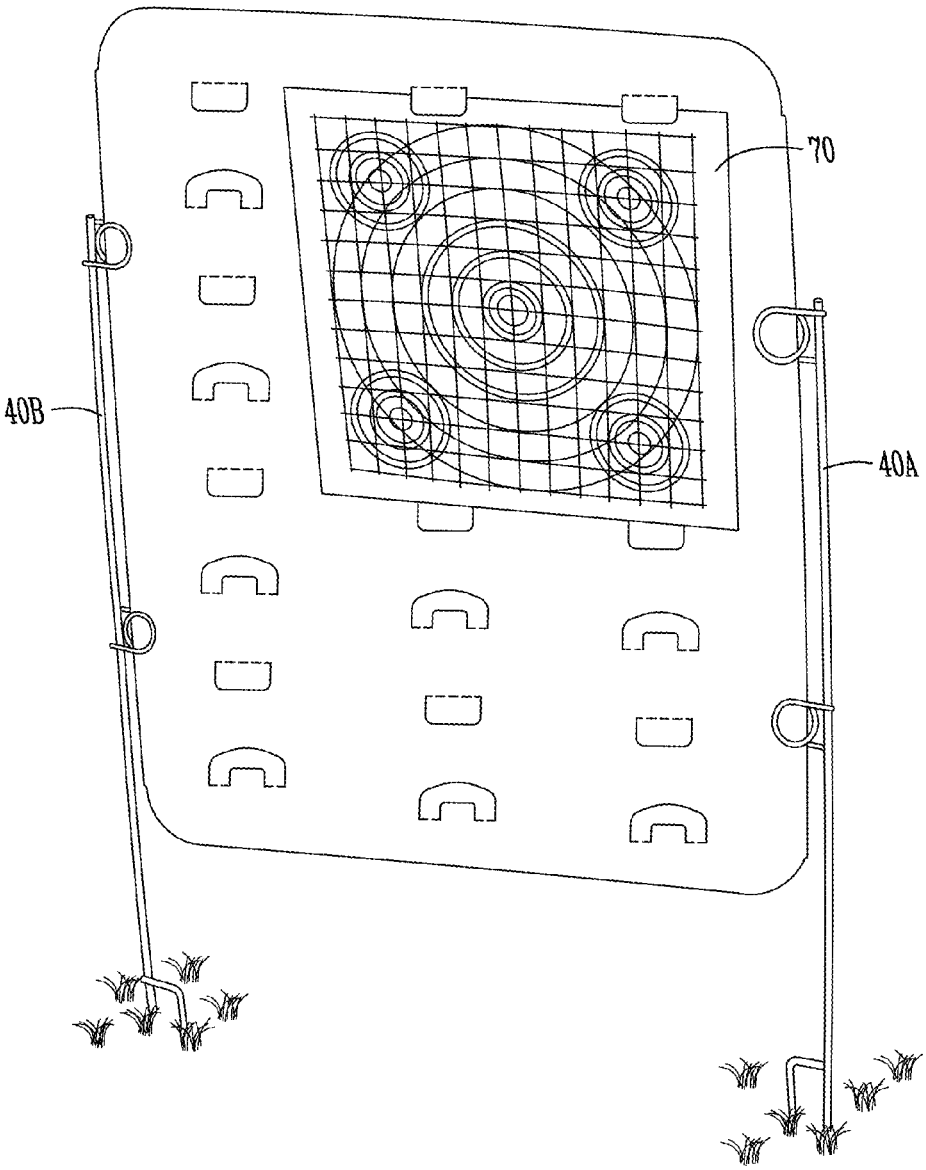
FIG. 5 illustrates the target body being supported by the first and second stands, with the tabs on the second side of the target body being used to support a paper target.

FIG. 5 illustrates the target body being supported by the first and second stand 40A, 40B, with the clips or tabs on the second side of the target body being used to support a paper target 70.

Figure 6:
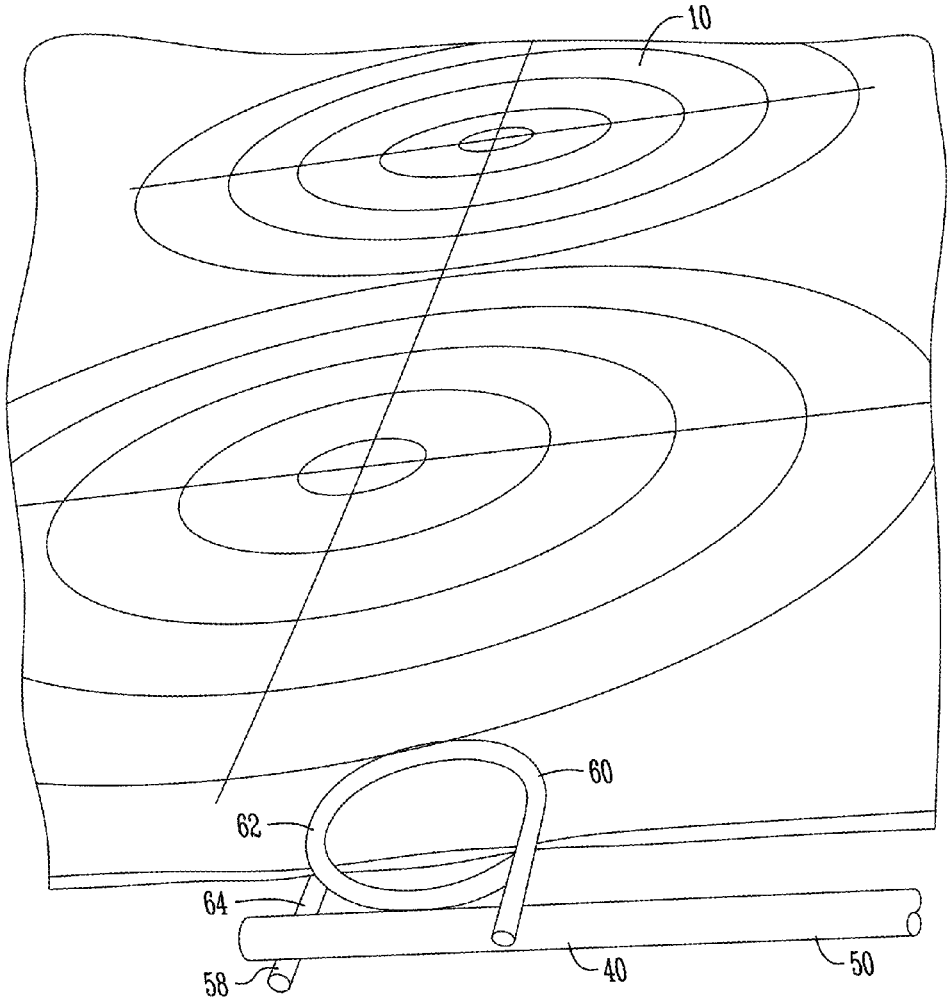
FIG. 6 illustrates a holder of one of the stands with the target body disposed within the holder.

FIG. 6 illustrates a holder 58 of a stand 40 with the target body disposed 10 within the holder 58. Note that the target body 10 may be positioned between a first loop 62 and a second loop 64 of the double loop structure 60.

Figure 7:
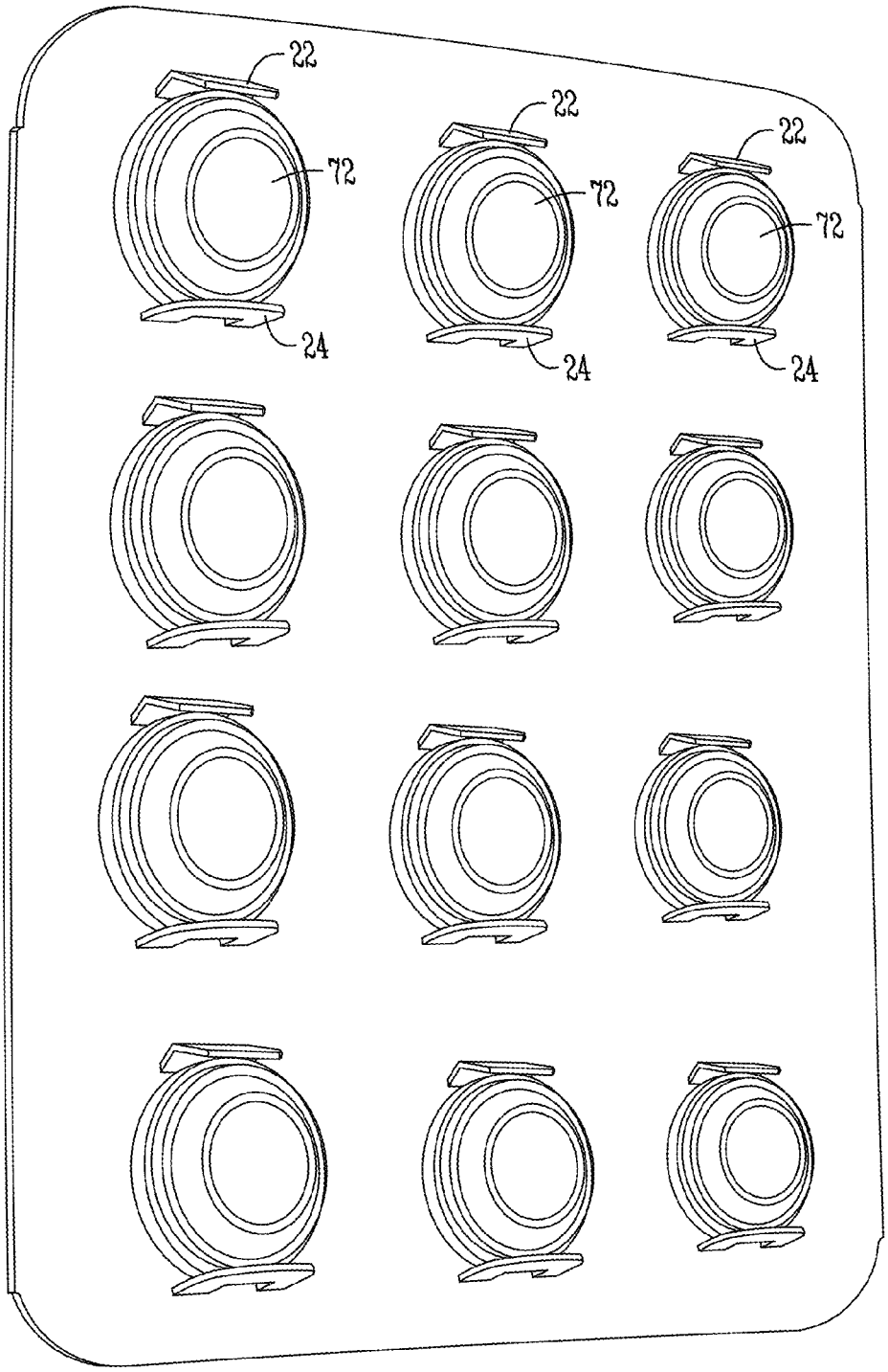
FIG. 7 illustrates a plurality of clay pigeons supported by the tabs on the second side of the target body.

FIG. 7 illustrates a plurality of clay targets 72 supported by the clips or tabs 22, 24 on the second side of the target body 10.

Figure 8:
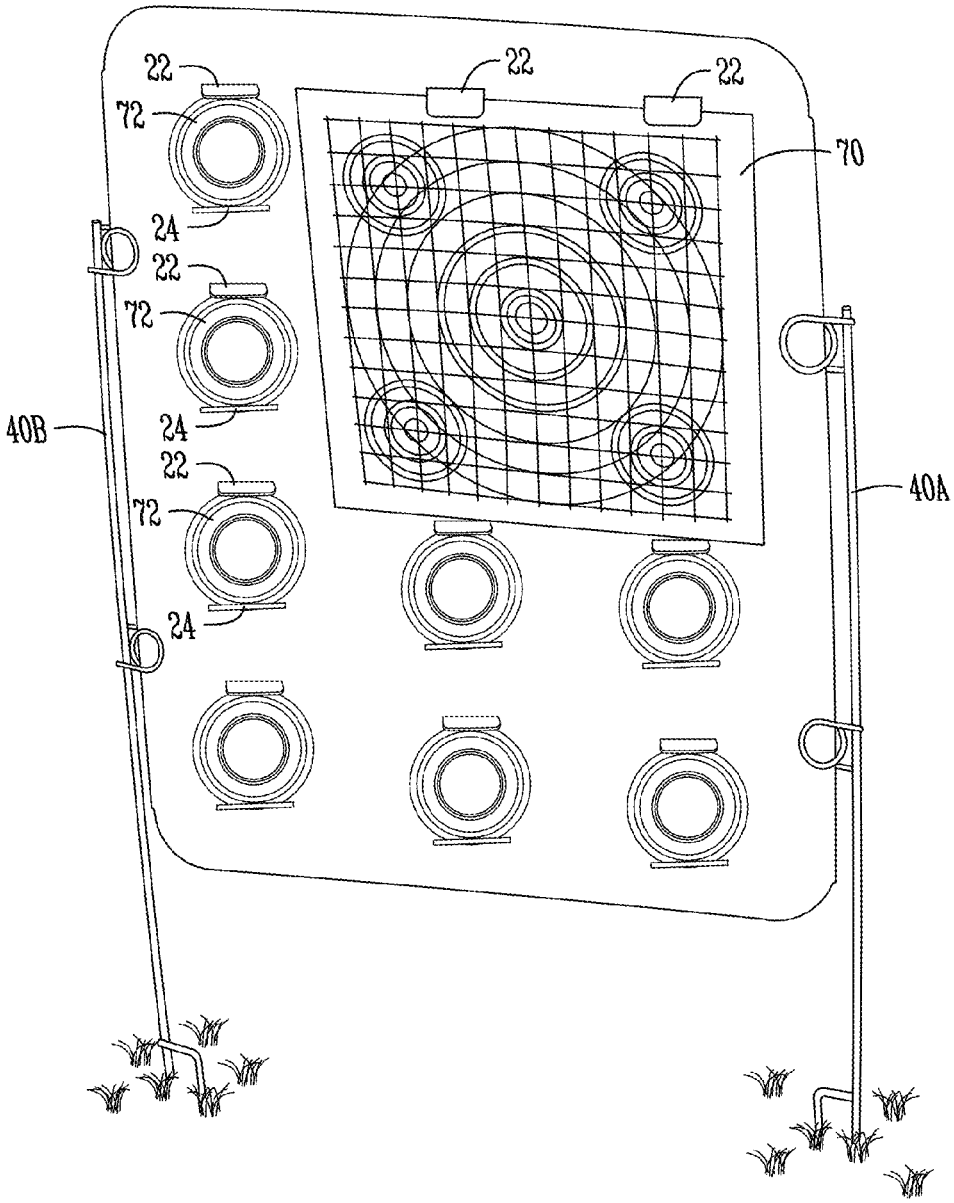
FIG. 8 illustrates a combination of clay pigeons and a paper target being supported by the tabs on the second side of the target body.

FIG. 8 illustrates a combination of clay pigeons 72 and a paper target 70 being supported by the clips or tabs 22, 24 on the second side of the target body 10.

Figure 9:
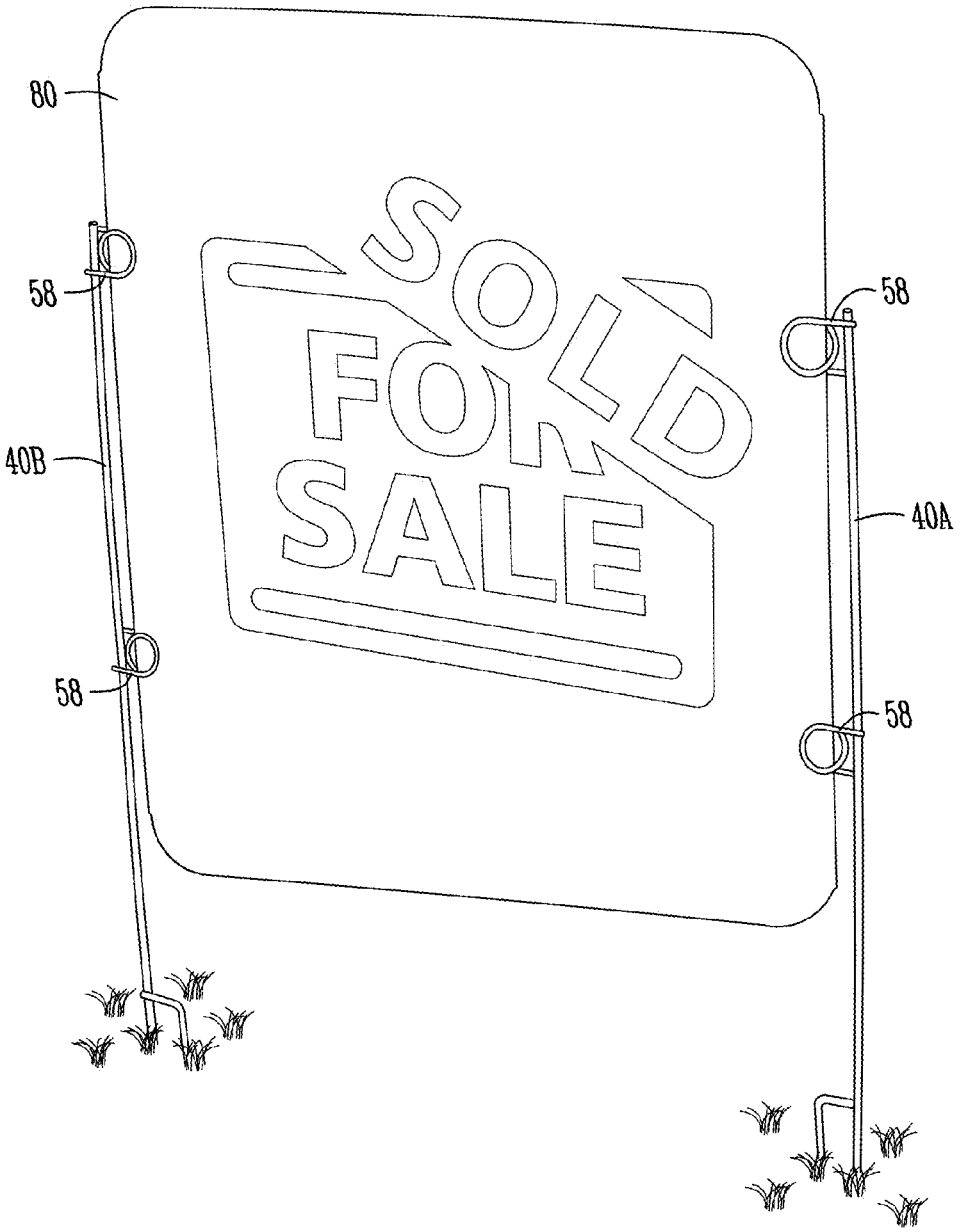
FIG. 9 illustrates stands holding signage.

FIG. 9 illustrates stands 40A, 40B holding signage 80. The structure provided for the holders 58 may also be used to hold signage 80. Often times, there is a need for temporary mounting of signs for various purposes. Examples may include for sale signs, garage sale signs, signs indicating parties, receptions, or weddings, or other events, as well as signs used for other purposes. In these instances, the stands 40A, 40B may be used to hold signage 80. The stands 40A, 40B used for signage 80 may have the same structure as the holders used for targets. Alternatively, the stands 40A, 40B for signage 80 may have a larger diameter of wire so as to provide additional support as signage stands 40A, 40B may be used for longer periods of time than stands 40A, 40B used for targets.

Figure 10:
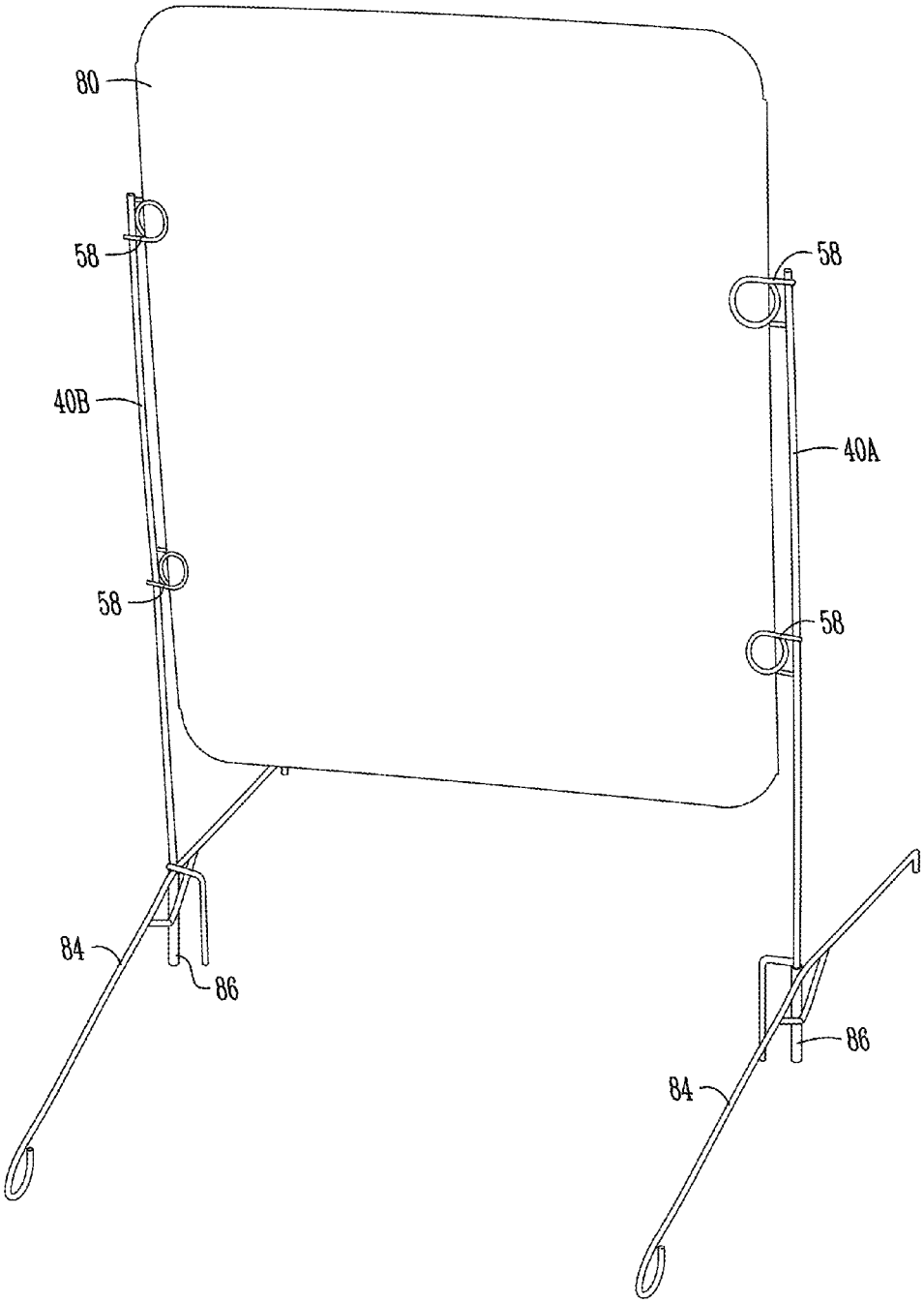
FIG. 10 illustrates stands with a base portion for use on hard ground or frozen ground.

FIG. 10 illustrates an example of stands 40A, 40B with base members 84. In the embodiment shown in FIG. 10, a base member 84 extends outwardly from each of the stands 40A, 40B. The base members 84 may be attached in various ways and may be removably attached. For example, the base members 84 may have holders 86 in which one leg of the stand 40A, 40B may fit. The base members 84 allow the stands 40A, 40B to be used when the ground is hard, such as during winter time when the ground is frozen, on rock, cement or other hard surfaces.

Figure 11:
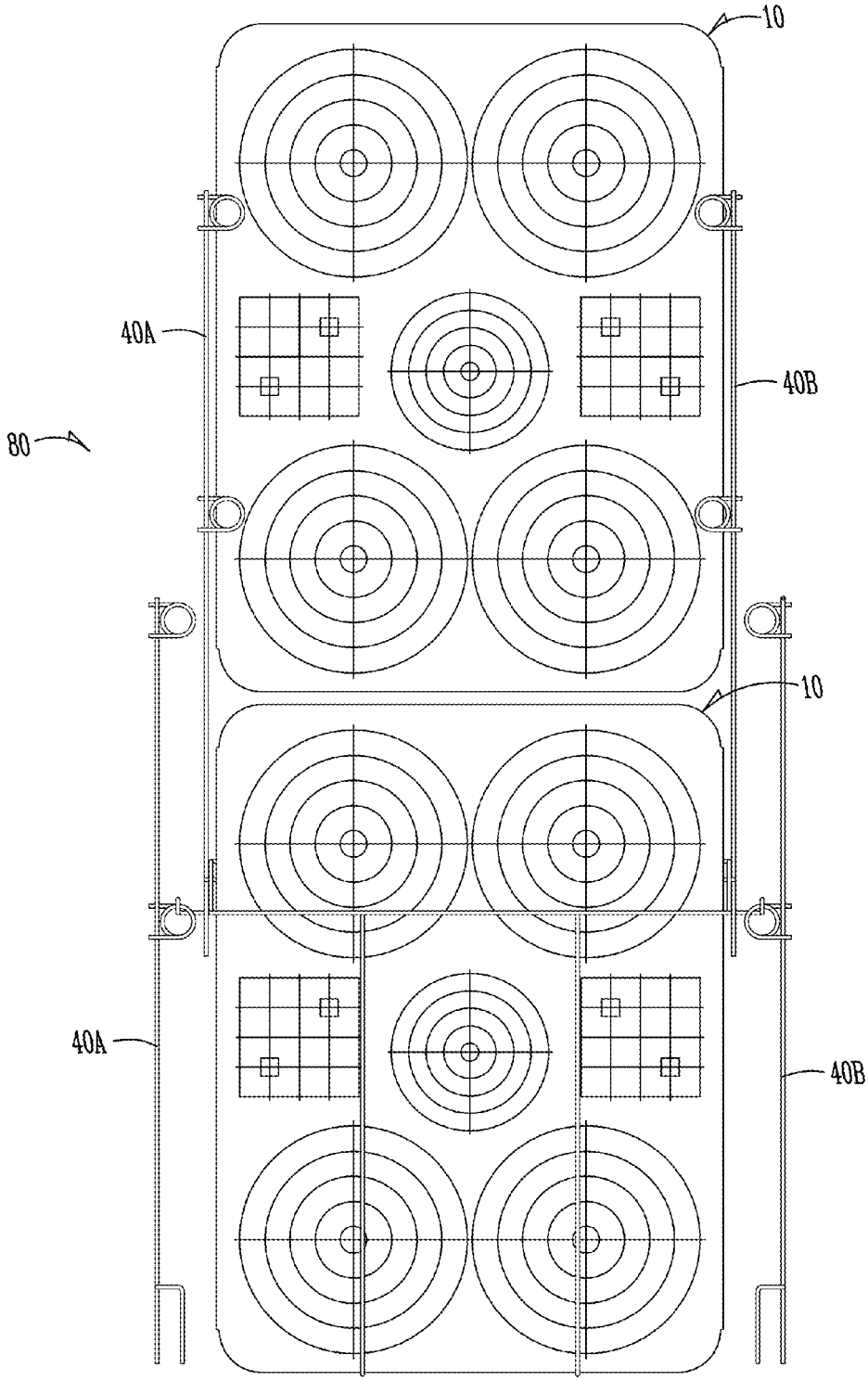
FIG. 11 illustrates a store display or merchandiser.
Figure 12:
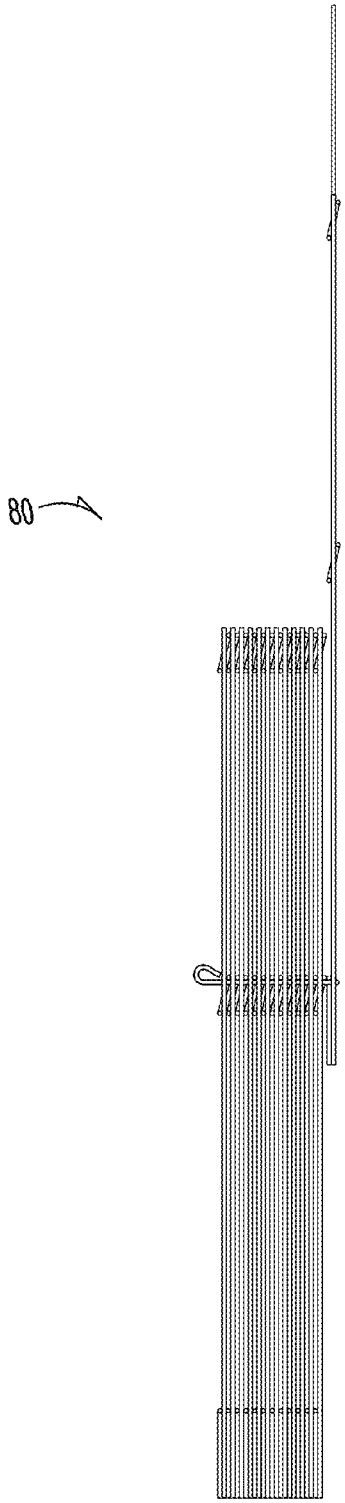
FIG. 12 is an end view of the merchandiser of FIG. 11.
Figure 13:
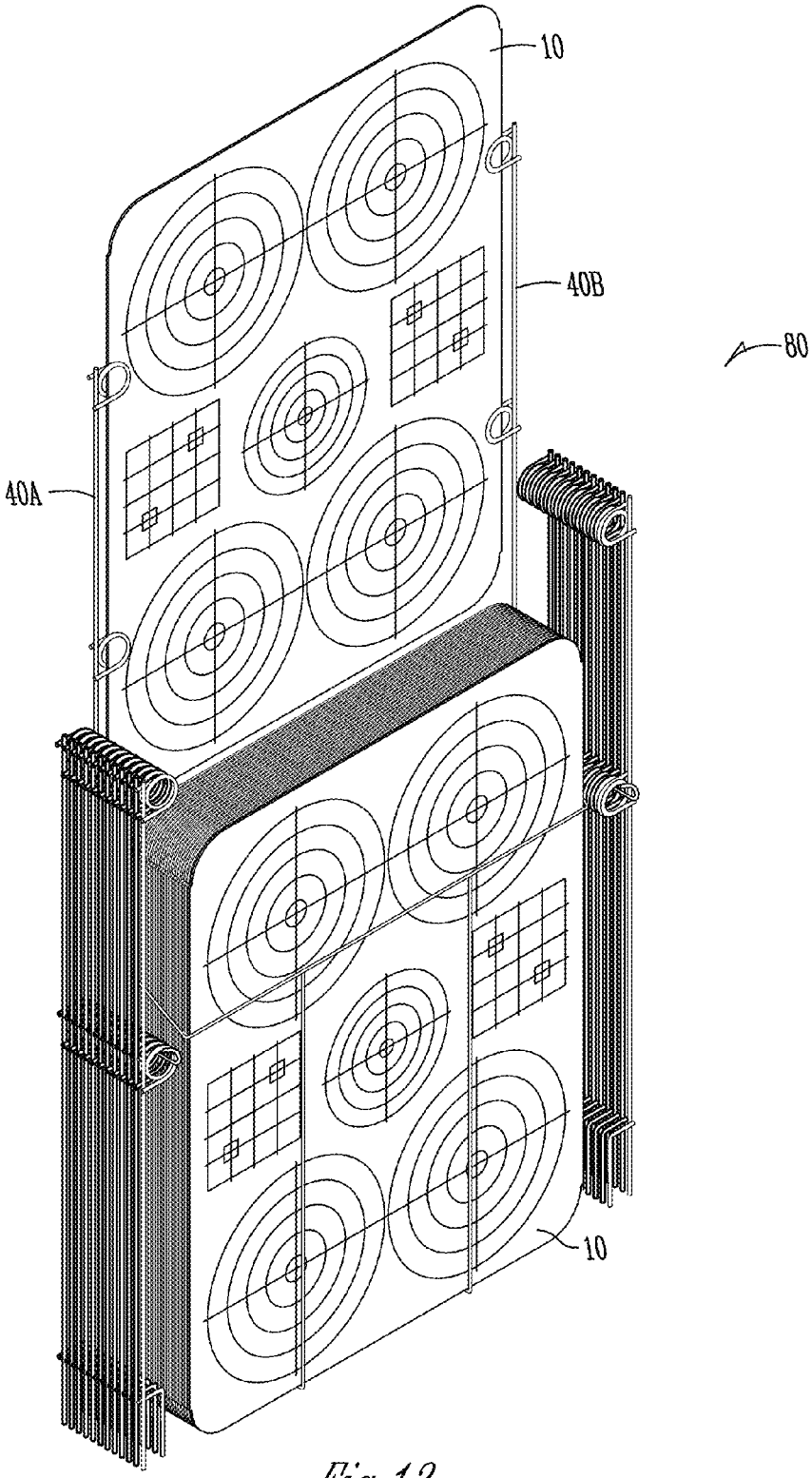
FIG. 13 is a perspective view of the merchandiser of FIG. 11 and FIG. 12.

FIG. 11, FIG. 12 and FIG. 13 illustrate a store display or merchandiser. The store display or merchandiser provides a means for displaying multi-purpose targets 10 and stands 40A, 40B in a manner that effectively illustrates the versatility and usefulness of the multi-purpose targets and holders. The store display is simple and effective at displaying a target in the stand. An arm on the store display may be used to hang the stands. The stands may be zip-tied together in sets of two. A first target may be mounted at a top portion of the support structure, and within a first and second of the plurality of stands. Additional targets and stands may be mounted below the first target.

Various embodiments of a multi-purpose reversible target, stands for use with the reversible target or signage, and a store display for the multi-purpose reversible targets and stands have been disclosed. It is to be appreciated that although specific embodiments are described herein, the present invention contemplates numerous variations, modifications, options, and alternatives.

What is claimed is:

1. A system of support for signage, comprising:

a first stand;

a second stand;

wherein each of the first stand and the second stand comprises (a) an elongated body having a top end and an opposite bottom end, the bottom end configured for insertion into ground (b) at least one holder operatively connected to the elongated body and comprising a first straight portion connected to a first side of the elongated body, the first straight portion extending into a first loop, the first loop extending into a second loop, and a second straight portion extending from the second loop to an opposite second side of the elongated body to thereby allow for friction fit of an edge of the signage between the first loop and the second loop of the holder.

2. The system of claim 1 wherein the bottom end comprises a first prong and a second prong for insertion into ground.

3. The system of claim 1 further comprising a first base member operatively connected to the first stand and a second base member operatively connected to the second stand.

4. The system of claim 1 wherein each of the first stand and the second stand is formed from a wire rod with each of the at least one holder welded thereto.

5. A stand for supporting signage, comprising:

an elongated body having a top end and an opposite bottom end, the bottom end configured for insertion into ground;

at least one holder operatively connected to the elongated body and comprising a first straight portion connected to a first side of the elongated body, the first straight portion extending into a first loop, the first loop extending into a second loop, and a second straight portion extending from the second loop to an opposite second side of the elongated body to thereby allow for friction fit of an edge of the signage between the first loop and the second loop of the holder.

6. The stand of claim 5 wherein the bottom end comprises a first prong and a second prong for insertion into ground.

7. The stand of claim 5 wherein the stand is formed from a wire od with each of the at least one holder welded thereto.

* * * * *

UNITED STATES PATENT AND TRADEMARK OFFICE

CERTIFICATE OF CORRECTION

PATENT NO. : 8,813,401 B2
APPLICATION NO. : 14/058394
DATED : August 26, 2014
INVENTOR(S) : Galen Diercks It is certified that error appears in the above-identified patent and that said Letters Patent is hereby corrected as shown below:

In the Claims

Col. 5, Claim 7, line 19:
DELETE after wire "od"
ADD after wire --rod--

Signed and Sealed this
Ninth Day of December, 2014

Michelle K. Lee

Michelle K. Lee
*Deputy Director of the United States Patent and Trademark Office*